US007540107B2

(12) United States Patent
Oum

(10) Patent No.: US 7,540,107 B2
(45) Date of Patent: Jun. 2, 2009

(54) FIREARM HOLSTER FOR RIFLE STOCK

(76) Inventor: Sarany Oum, P.O. Box 5992, Twin Falls, ID (US) 83303

( * ) Notice: Subject to any disclaimer, the term of this patent is extended or adjusted under 35 U.S.C. 154(b) by 59 days.

(21) Appl. No.: 11/727,343

(22) Filed: Mar. 26, 2007

(65) Prior Publication Data

US 2008/0000131 A1 Jan. 3, 2008

Related U.S. Application Data

(60) Provisional application No. 60/786,713, filed on Mar. 29, 2006.

(51) Int. Cl.
*F41C 23/00* (2006.01)

(52) U.S. Cl. ..... 42/71.01

(58) Field of Classification Search ..... 224/149, 224/191–193, 243, 911, 912, 250; 42/85, 42/71.01, 71.02, 72, 73, 106
See application file for complete search history.

(56) References Cited

U.S. PATENT DOCUMENTS

| | | | | | |
|---|---|---|---|---|---|
| 276,593 | A | * | 5/1883 | Jett | 42/71.01 |
| 458,824 | A | * | 9/1891 | Daudeteau | 42/71.01 |
| 762,862 | A | * | 6/1904 | Phillips | 42/72 |
| 894,101 | A | * | 7/1908 | Balson | 42/71.01 |
| 1,266,632 | A | * | 5/1918 | Sachs | 42/72 |
| 1,266,633 | A | * | 5/1918 | Sachs | 42/72 |
| 1,554,556 | A | * | 9/1925 | Camus | 42/72 |
| 1,557,865 | A | * | 10/1925 | Neel et al. | 42/72 |
| 1,844,603 | A | * | 2/1932 | Sarson | 224/911 |
| 2,055,168 | A | | 9/1936 | Blacker | |
| 2,193,310 | A | * | 3/1940 | Brant | 42/74 |
| 2,433,151 | A | | 12/1947 | Parsons | |
| 2,495,977 | A | * | 1/1950 | Madsen | 42/71.01 |
| 2,605,033 | A | * | 7/1952 | Terry | 224/0.5 |
| 2,683,948 | A | * | 7/1954 | Catron | 42/72 |
| 3,167,875 | A | * | 2/1965 | Winner et al. | 42/106 |
| 3,638,344 | A | * | 2/1972 | Wagner et al. | 42/71.01 |
| 3,641,694 | A | * | 2/1972 | Seidel et al. | 42/72 |
| 3,796,358 | A | | 3/1974 | Grubb | |
| D248,866 | S | | 8/1978 | Gonzales | |
| 4,127,953 | A | * | 12/1978 | McBride | 42/97 |
| 4,258,871 | A | | 3/1981 | McMahon | |

(Continued)

FOREIGN PATENT DOCUMENTS

| | | |
|---|---|---|
| EP | 0174908 A2 | 3/1986 |

*Primary Examiner*—Troy Chambers
*Assistant Examiner*—Jonathan C Weber
(74) *Attorney, Agent, or Firm*—Richard C. Litman

(57) ABSTRACT

The combination firearm holster and rifle stock includes a rifle stock and a firearm holster. The rifle stock has a proximal end and a distal end, where the distal end is for removable attachment to a rifle. The rifle stock also has a depressed portion disposed along one side. The firearm holster is permanently secured to the rifle stock within the depressed portion of the rifle stock. A firearm holster for detachable attachment to stock of a rifle includes a firearm holster and one or more straps or a plurality of fasteners. The one or more straps are connected to the firearm holster and are used for securing the firearm holster to the stock of the rifle. The fasteners can be disposed through a portion of the firearm holster and are used for securing the firearm holster to the stock of the rifle.

8 Claims, 6 Drawing Sheets

U.S. PATENT DOCUMENTS 4,276,807 A * 7/1981 Whitlock ..... 42/72
4,299,343 A * 11/1981 Atchisson ..... 224/149
4,316,342 A * 2/1982 Griggs ..... 42/74
4,450,992 A * 5/1984 Casull ..... 224/163
5,092,070 A * 3/1992 Perkins ..... 42/72
5,121,564 A 6/1992 Story
D335,221 S 5/1993 Nichols
5,265,365 A * 11/1993 Finn ..... 42/74
5,755,055 A * 5/1998 Thompson et al. ..... 42/71.01
5,957,308 A * 9/1999 Zierenberg ..... 211/64
5,988,467 A 11/1999 Brustein
6,076,715 A 6/2000 Easter
6,374,719 B1 4/2002 Phillips
6,829,855 B2 * 12/2004 Seifert ..... 42/72
6,874,618 B1 4/2005 Cragg
2001/0019071 A1 * 9/2001 Vor Keller et al. ..... 224/911
2003/0200693 A1 * 10/2003 Seifert ..... 42/71.01

* cited by examiner

FIREARM HOLSTER FOR RIFLE STOCK

CROSS-REFERENCE TO RELATED APPLICATION

This application claims the benefit of U.S. Provisional Patent Application Ser. No. 60/786,713, filed Mar. 29, 2006.

BACKGROUND OF THE INVENTION

1. Field of the Invention

The present invention relates to firearm holsters, and more specifically to a firearm holster for a rifle stock for permanent or detachable connection to the stock of assault rifles.

2. Description of the Related Art

Rifles, especially tactical assault rifles, have become increasingly popular for use in military and other combat situations. As such, efforts have been dedicated to the development of sidearm or pistol mounts toward the front forearm of these rifles. However, such forward mounts present problems, particularly because they make access and use of the sidearms they hold difficult during close-quarter combat and during other times of urgent need.

It would be desirable to provide a firearm mount for use with a rifle that provides a quicker means of reaching a sidearm in real-life combat situations, where speed is critical to matters of life and death. It is desirable that these mounts be either permanently affixed to the stock of a rifle or be capable of being easily attached and detached from a rifle stock for use on multiple rifles. Thus, a firearm holster for use with a rifle stock solving the aforementioned problems is desired.

SUMMARY OF THE INVENTION

The firearm holster for a rifle stock may be either a holster permanently attached to a rifle stock or a holster adapted for removable attachment to a rifle stock. In a first embodiment, the firearm holster for a rifle stock is a combination firearm holster and rifle stock, and includes a rifle stock and a firearm holster permanently attached thereto. The rifle stock has a proximal end (held proximal to the shooter when the rifle is used) and a distal end, where the distal end is for removable attachment to a rifle. The rifle stock also has a depressed portion disposed along one side substantially near the proximal end. The firearm holster is permanently secured to the rifle stock within the depressed portion of the rifle stock.

In another embodiment, the firearm holster for a rifle stock is a firearm holster for detachable attachment to stock of a rifle and includes a firearm holster and one or more straps. The one or more straps are connected to the firearm holster and are used for securing the firearm holster to the stock of the rifle. In still another embodiment, a firearm holster for detachable attachment to stock of a rifle includes a firearm holster and one or more fasteners. The one or more fasteners can be disposed through a portion of the firearm holster and are used for securing the firearm holster to the stock of the rifle.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
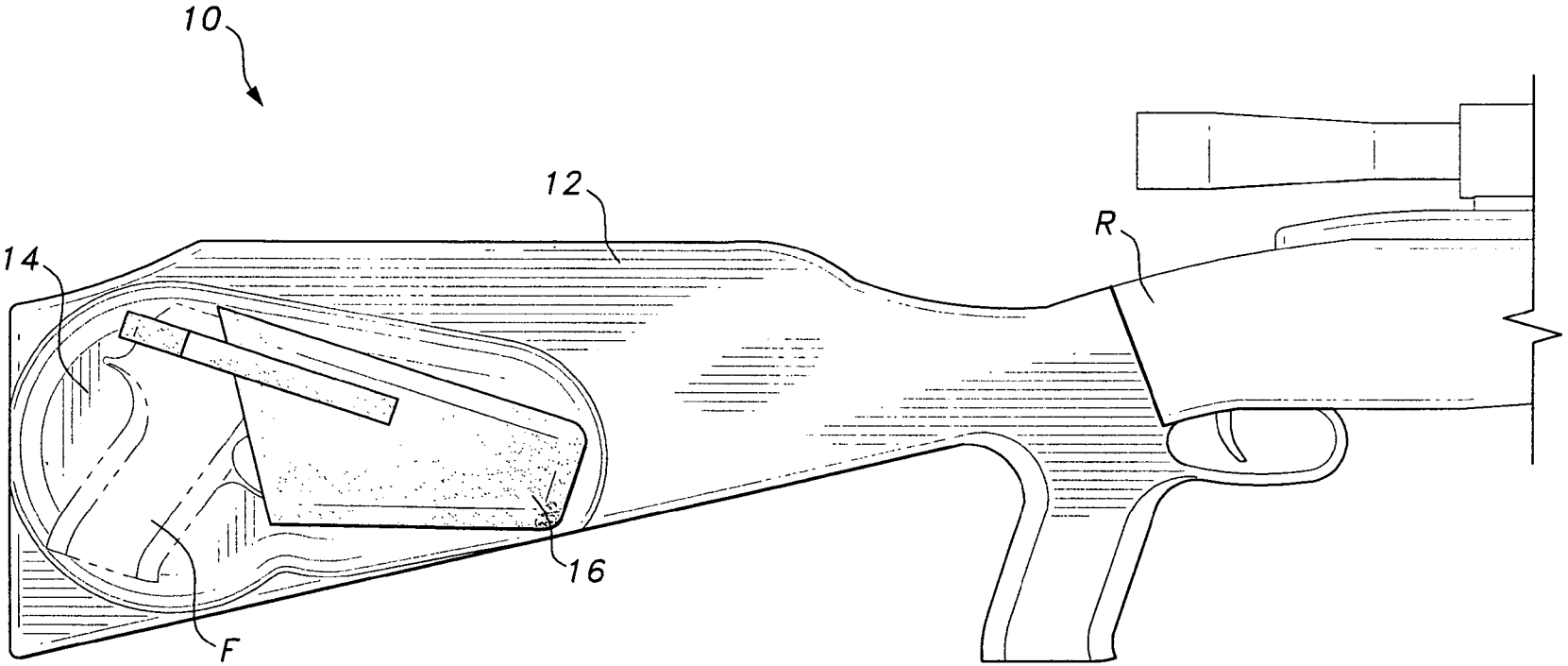
FIG. 1 is an environmental side view of a first embodiment of a firearm holster for a rifle stock according to the present invention in which the holster is permanently attached to the stock.
Figure 2:
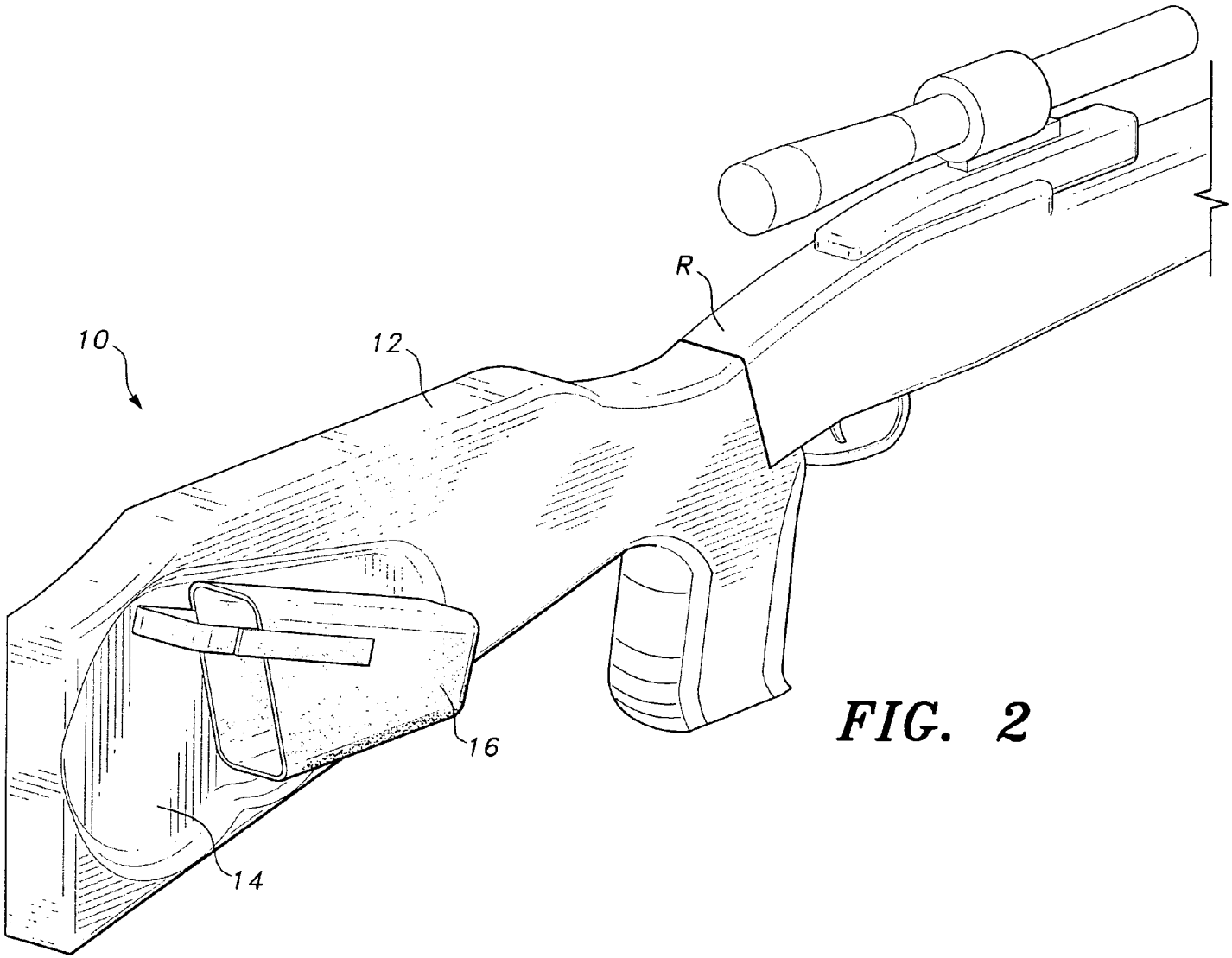
FIG. 2 is a perspective view of the firearm holster for a rifle stock of FIG. 1.

The present invention relates to handgun holsters either permanently or removably mounted on the stock of a rifle, particularly an assault rifle. In a first embodiment, the firearm holster for a rifle stock is a combination firearm holster and rifle stock, designated generally as 10 in the drawings. Referring to FIGS. 1 and 2, combination firearm holster and rifle stock 10 is shown in connection with rifle R. Many rifles, especially assault-type rifles for use in close-quarter combat situations, include rifle stocks that are interchangeable. Combination firearm holster and rifle stock 10 includes rifle stock 12 and firearm holster 16.

Rifle stock 12 has a proximal end and a distal end, where the distal end is removably attached to rifle R. Rifle stock 12 also includes a recess or depressed portion 14 disposed along one side substantially near the proximal end. Holster 16 is permanently secured to rifle stock 12 within depressed portion 14 via any suitable means. Holster 16 is preferably suited for holding a firearm F, such as a pistol-type sidearm or other handgun, and may be of any configuration necessary for accomplishing this task. Depressed portion 14, being located entirely near the proximal end of the stock, allows a user wishing to grab firearm F from holster 16 to have quick and complete access to the handle of firearm F. Combination firearm holster and rifle stock 10 provides a quicker means of reaching a sidearm in real-life combat situations, where speed is critical to life and death, than a conventional holster. The stock is removably attachable to the body of any rifle configured to receive the stock.

Holster 16 is a tubular sheath made from leather, cowhide, or other suitable material known in the art, and is dimensioned and configured for holding a handgun. The holster 16 shown in FIGS. 1 and 2 is equipped with a strap that may be wrapped over the butt end of the handgun and secured by a snap, buckle, or other fastener to prevent the handgun from accidentally falling out of the holster 16. However, the holster 16 shown in the drawings is exemplary only, and any handgun holster may be used in any of the embodiments of the present invention. Holster 16 may be attached to detachable rifle stock 10 by any suitable permanent fastener, i.e., a fastener that does not permit the holster 16 to be removed from the stock 10 without damage to the holster 16 or the stock 10, e.g., permanent adhesive, rivets, etc.

Figure 3:
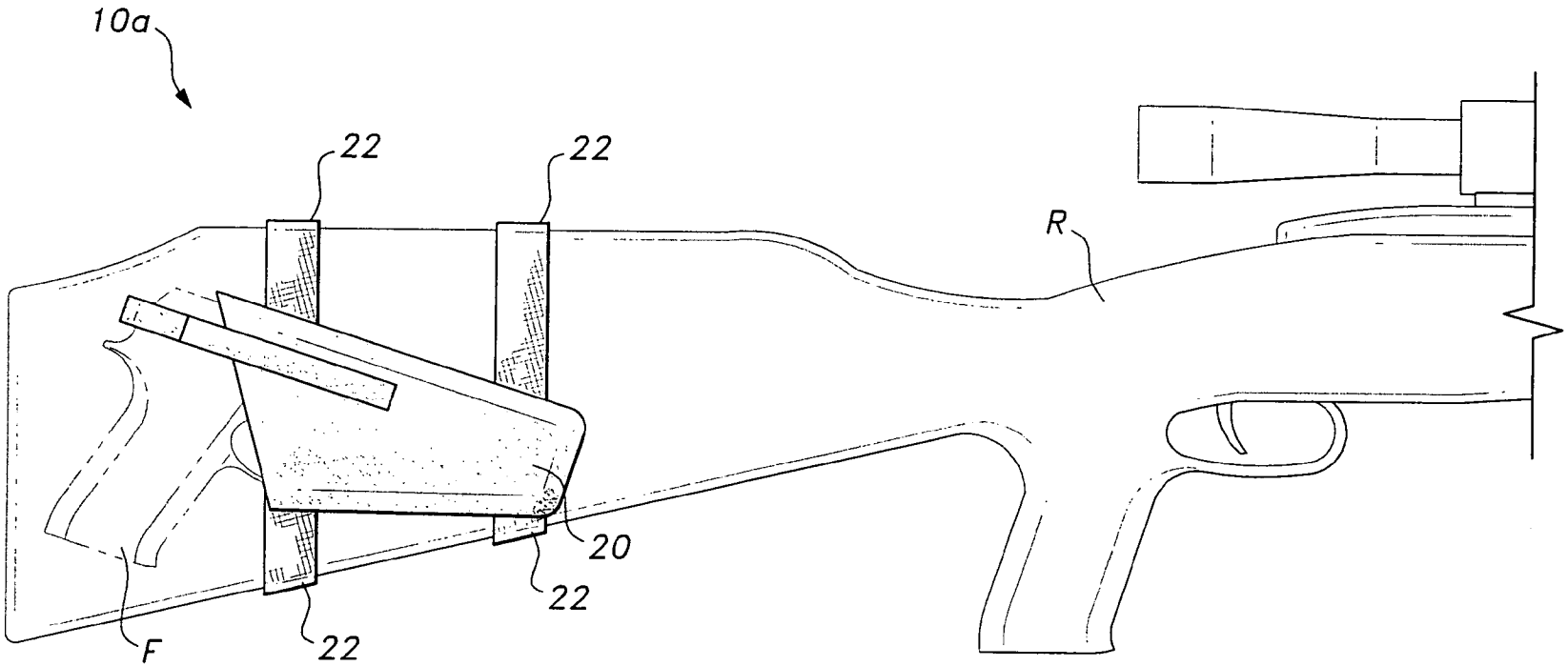
FIG. 3 is an environmental side view of a second embodiment of a firearm holster for a rifle stock according to the present invention in which the holster is releasably attached to the stock by straps.
Figure 4:
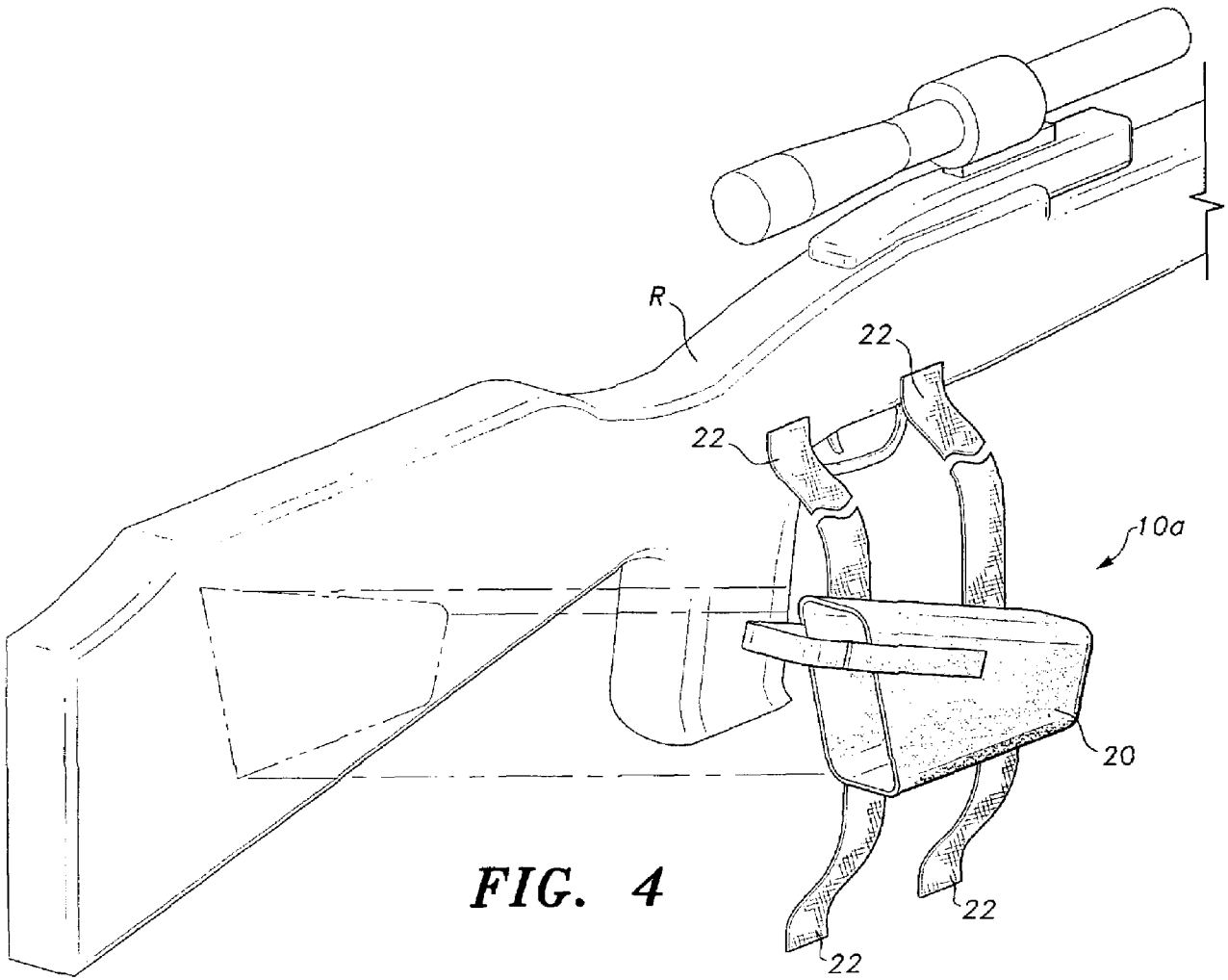
FIG. 4 is an exploded, perspective view of the firearm holster for a rifle stock of FIG. 3.

Turning now to FIGS. 3 and 4, detachable firearm holster 10*a* is shown in use with a rifle R. Detachable firearm holster 10*a* is for detachable attachment to the stock of rifle R and includes a holster 20 and one or more straps 22. Straps 22 are attached to holster 20 and equipped with any suitable releasable fastener (e.g., hook and loop, snaps, buckles, cinches, etc.) for closing the straps 22 and securing holster 20 to the stock of rifle R. The straps 22 may be releasably attached to the holster 20. Holster 20 is preferably suited for holding a firearm F, such as a pistol-type sidearm or handgun, and may be of any configuration necessary for accomplishing this task. Holster 20 is configured so that a user wishing to grab firearm F from detachable firearm holster 10*a* has quick and complete access to the handle of firearm F. The stock of the rifle R may or may not have a depression or recess for receiving at least a portion of the handgun or firearm F, and may not be detachable from the body of the rifle.

Figure 5:
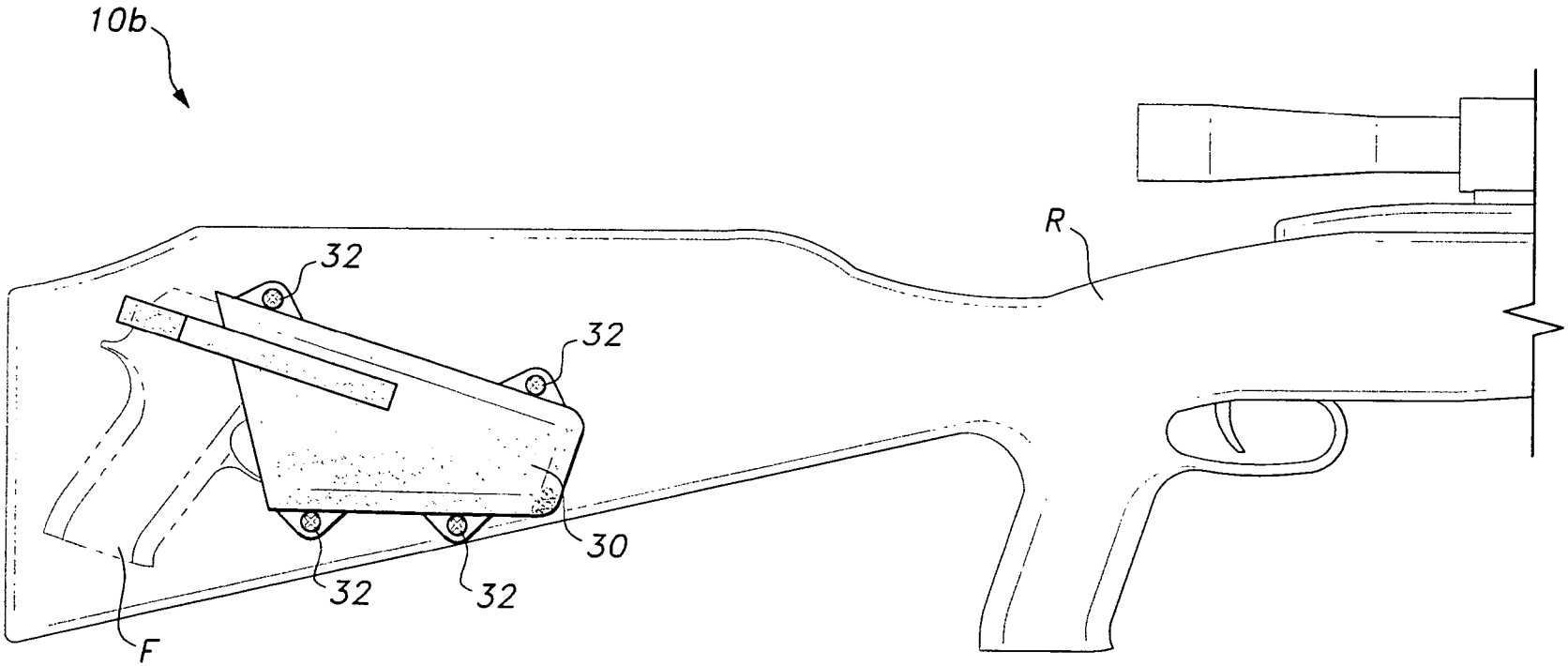
FIG. 5 is an environmental side view of a third embodiment of a firearm holster for a rifle stock according to the present invention in which the holster is removably attached to the stock by fasteners.
Figure 6:
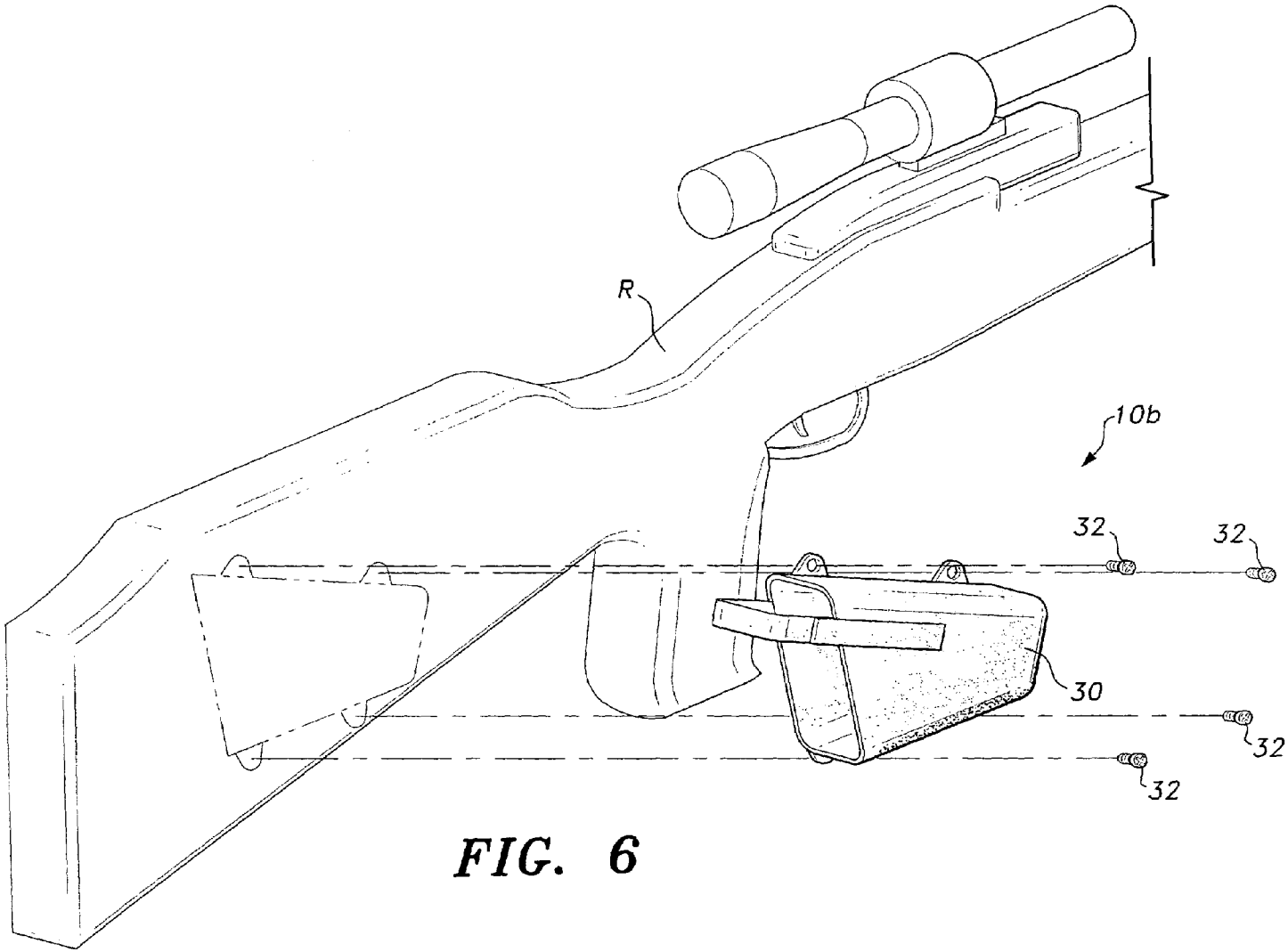
FIG. 6 is an exploded, perspective view of the firearm holster for a rifle stock of FIG. 5.

FIGS. 5 and 6 show an alternative embodiment of detachable firearm holster 100*b* in use with a rifle R. Detachable firearm holster 10*b* is for detachable attachment to the stock of rifle R and includes a holster 30 and one or more fasteners 32. Fasteners 32 are disposed through fastener holes defined in holster 30, or through tabs, mounting lugs, a mounting plate or bracket, etc., attached to or extending from holster 30 and are provided for securing holster 30 to the stock of rifle R. Holster 30 is preferably suited for holding a firearm F, most likely a pistol-type sidearm, and may be of any configuration necessary for accomplishing this task. Holster 30 is configured so that a user wishing to grab firearm F from detachable firearm holster 10*b* has quick and complete access to the handle of firearm F. Fasteners 30 may be threaded bolts, as shown, or any other suitable releasable fasteners. In the particular example of FIG. 6, where fasteners 32 are in the form of threaded bolts, the threaded bolts are received within complementary threaded bores formed within rifle stock 10*b*. The stock of the rifle R may or may not have a depression or recess for receiving at least a portion of the handgun or firearm F, and may not be detachable from the body of the rifle.

It is to be understood that the present invention is not limited to the embodiments described above, but encompasses any and all embodiments within the scope of the following claims.

I claim:

1. A combination firearm holster and rifle stock, comprising:

a rifle stock having a proximal end and a distal end, the distal end being adapted for removable and releasable attachment to a rifle body, the rifle stock having a first predetermined thickness at the distal end and a substantially equal second thickness at the proximal end, the rifle stock having a depressed portion disposed along one side thereof, the depressed portion being entirely located substantially near the proximal end and defining a third thickness less than the first and second thickness, said depressed portion being sized and configured to retain a firearm holster and firearm therein;

a firearm holster, said firearm holster defining a tubular sheath for encasing and supporting a firearm placed therewithin; and means for securing the firearm holster to the rifle stock at least partially within the depressed portion, whereby the depressed portion permits a user to have quick and complete access to the handle of a firearm.

2. The combination firearm holster and rifle stock as recited in claim 1, wherein said means for securing the firearm holster to the rifle stock comprises means for permanently securing the firearm holster to the rifle stock.

3. The combination firearm holster and rifle stock as recited in claim 1, wherein said means for securing the firearm holster to the rifle stock comprises means for releasably securing the firearm holster to the rifle stock.

4. The combination firearm holster and rifle stock as recited in claim 3, wherein said means for releasably securing the firearm holster to the rifle stock comprises at least one releasable fastener.

5. The combination firearm holster and rifle stock as recited in claim 4, wherein said rifle stock has at least one threaded bore defined therein, the at least one releasable fastener comprising at least one threaded bolt engaging the at least one threaded bore in the rifle stock.

6. The detachable holster in combination with a rifle according to claim 4, wherein said means for releasably securing the firearm holster to the rifle stock comprises a plurality of straps attached to said holster, the straps being wrappable around and securable to the stock of the rifle.

7. The detachable holster according to claim 1, wherein said holster further comprises a plurality of tabs extending from the tubular sheath, the tabs having fastener holes defined therein, said means for removably attaching comprising a plurality of threaded fasteners extending through the holes in the tabs and adapted for engaging threaded bores defined in the stock of the rifle.

8. The detachable holster according to claim 1, wherein further comprising a bracket attached to the tubular sheath and extending from the tubular sheath, the bracket having fastener holes defined therein, said means for removably attaching comprising a plurality of threaded fasteners extending through the holes in the brackets and adapted for engaging threaded bores defined in the stock of the rifle.

* * * * *